US006449783B1

(12) United States Patent
Moser

(10) Patent No.: US 6,449,783 B1
(45) Date of Patent: Sep. 17, 2002

(54) ENERGY TRANSFERRING TOILET SEAT

(76) Inventor: Scott A. Moser, 800 Silverado St. Suite 324, La Colla, CA (US) 92037

( * ) Notice: Subject to any disclaimer, the term of this patent is extended or adjusted under 35 U.S.C. 154(b) by 0 days.

(21) Appl. No.: 09/893,474

(22) Filed: Jun. 29, 2001

(51) Int. Cl.[7] ..... A47K 13/10
(52) U.S. Cl. ..... 4/667; 4/254
(58) Field of Search ..... 4/236, 240, 254, 4/667

(56) References Cited

U.S. PATENT DOCUMENTS

| | | | | |
|---|---|---|---|---|
| 1,839,452 A | * | 1/1932 | Thompson | 4/240 X |
| 2,598,577 A | | 5/1952 | Mattison | 4/237 |
| 3,473,174 A | | 10/1969 | Cool | 4/667 |
| 3,479,087 A | | 11/1969 | Burke | 297/339 |
| 3,802,000 A | | 4/1974 | Waldon | 4/236 |
| 4,133,061 A | | 1/1979 | Hurd | 4/236 |
| 4,159,548 A | | 7/1979 | Hewson | 4/236 |
| 4,173,802 A | * | 11/1979 | Wikstrom | 4/236 |
| 4,185,335 A | | 1/1980 | Alvis | 4/667 |
| 4,319,365 A | | 3/1982 | Bemis et al. | 4/236 |
| 4,326,307 A | | 4/1982 | Baillie et al. | 4/236 |
| 4,367,567 A | | 1/1983 | Sendoykas | 16/263 |
| 4,538,853 A | | 9/1985 | Levenberg | 297/339 |
| 4,587,675 A | | 5/1986 | Love et al. | 4/667 |
| 4,690,457 A | | 9/1987 | Poncy et al. | 297/337 |
| 4,833,736 A | | 5/1989 | Sadler et al. | 4/667 |
| 4,884,841 A | | 12/1989 | Holley | 297/331 |
| 4,907,303 A | | 3/1990 | Baird | 4/480 |
| 4,965,889 A | | 10/1990 | Tissot et al. | 4/234 |
| 4,993,085 A | | 2/1991 | Gibbons | 4/667 |
| 5,063,617 A | | 11/1991 | Ward et al. | 4/667 |
| 5,082,327 A | | 1/1992 | Crisp | 297/313 |
| 5,142,709 A | | 9/1992 | McGuire | 4/667 |
| 5,175,891 A | | 1/1993 | Ohshima et al. | 4/236 |
| 5,189,739 A | | 3/1993 | Thierry | 4/254 |
| 5,316,370 A | | 5/1994 | Newman | 297/313 |
| 5,414,875 A | | 5/1995 | Kappl et al. | 4/236 |
| 5,588,162 A | | 12/1996 | Robinson | 4/667 |
| 5,592,703 A | | 1/1997 | Jones et al. | 4/667 |
| 5,626,389 A | | 5/1997 | Logan, Jr. | 297/250.1 |
| 5,661,858 A | | 9/1997 | House et al. | 4/667 |
| 5,933,875 A | | 8/1999 | Hulsebus et al. | 4/240 |
| 6,067,674 A | | 5/2000 | Moser | 4/667 |
| 6,070,295 A | | 6/2000 | Hulsebus | 16/254 |

* cited by examiner

*Primary Examiner*—Robert M. Fetsuga
(74) *Attorney, Agent, or Firm*—Welsh & Flaxman LLC

(57) ABSTRACT

A toilet seat apparatus including a base member adapted for selective attachment to a toilet, a unitary one-piece seat pivotally secured to the base member such that the seat may rotate forward, and an energy storing strut including a first end coupled to the base member and a second end coupled to the seat.

15 Claims, 11 Drawing Sheets

FIG.13
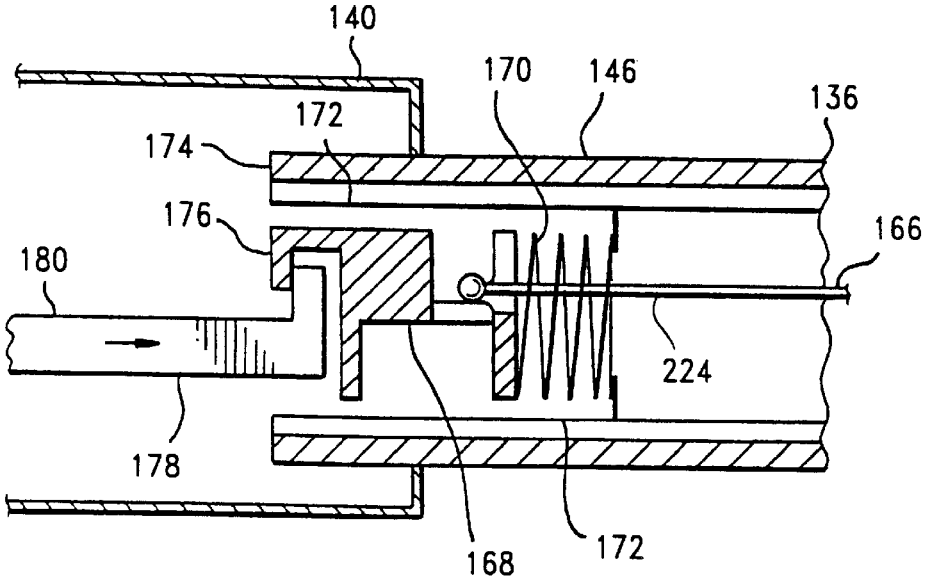
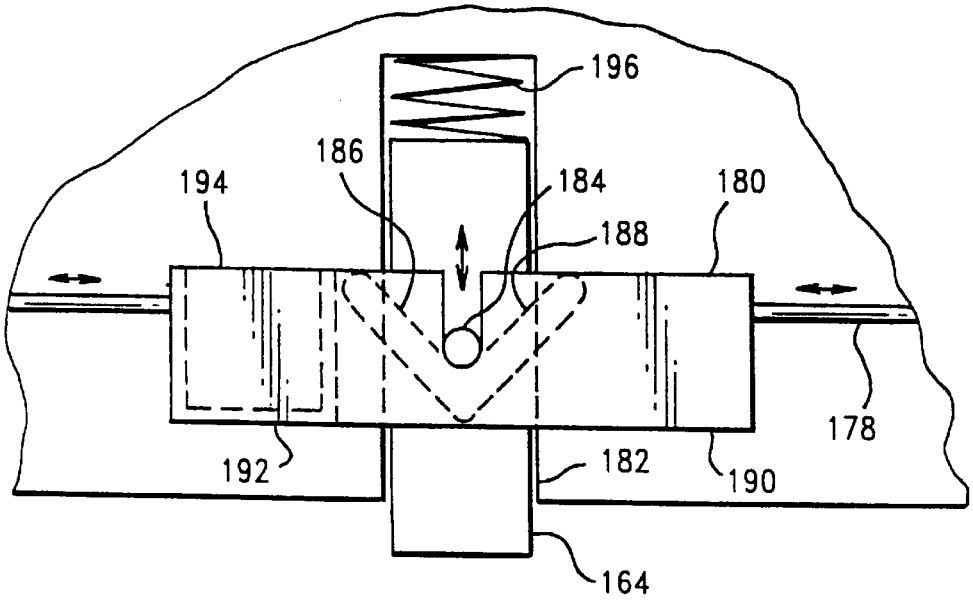
FIG.14

ENERGY TRANSFERRING TOILET SEAT

BACKGROUND OF THE INVENTION

1. Field of the Invention

The present invention relates to toilet seats. More particularly, the present invention relates to toilet seats including lowering and lifting mechanisms assisting a user when engaging and disengaging a toilet.

2. Description of the Prior Art

Lifting toilet seats have been provided by artisans wishing to address problems some persons may have in using common toilets. A common toilet is designed to accommodate healthy persons in a sitting position. Persons wishing to use a toilet generally start from a standing position and bend their knees to sit on a toilet seat. While most would not pay mind to this relatively common act, many persons are disabled in a manner which prevents them sitting upon a toilet without great difficulty.

Consequently, inventors have set forth and applied their skills in an attempt to solve this problem. For example, U.S. Pat. No. 5,592,703 discloses a powered toilet seat lift. The device employs fluid powered cylinders to lift a seat vertically from a toilet bowl. The complex arrangement is not easy to install or clean, and may be expensive as it requires a great deal of specialized materials and equipment. Alternatively, Hydra-Commode Lift Services Inc. teach a hydraulically activated device to raise a person from a toilet. The device is primarily concerned with lifting large loads and is, therefore, designed with special features which may address those problems. Again, the device may serve well its main purpose, but it requires a complex machine and installation which might not suit all facilities. The elderly particularly have a difficult time installing such devices and would likely find this machine cumbersome.

In U.S. Pat. No. 5,082,327 to Ward et al. a chair having a seat which operates to lift its user therefrom is disclosed. Ward et al. also disclose a toilet seat designed with the intention of aiding one's use of a toilet. U.S. Pat. No. 5,063,617 shows a detailed presentation relating to a tilting seat driven by hydraulic pressure. Finally U.S. Pat. No. 4,993,085 shows another technique for employing fluid power to urge one from a sitting position.

Notwithstanding, applicant has developed a novel toilet seat in combination with stored energy devices, particularly to assist persons, especially the infirm, elderly, or otherwise disabled, as they use toilets.

SUMMARY OF THE INVENTION

It is, therefore, an object of the present invention to provide a toilet seat apparatus including a base member adapted for selective attachment to a toilet, a unitary one-piece seat pivotally secured to the base member such that the seat may rotate forward, and an energy storing strut including a first end coupled to the base member and a second end coupled to the seat.

It is also an object of the present invention to provide a toilet seat apparatus including a base member adapted for selective attachment to a toilet, a seat pivotally secured to the base member such that the seat may rotate forward and an energy storing strut including a first end coupled to the base member and a second end coupled to the seat. The seats includes laterally spaced first and second pivot pins shaped and dimensioned for respective receipt in supports formed in a top surface of the base member.

It is further an object of the present invention to provide a toilet seat including a base member adapted for selective attachment to a toilet, a seat pivotally secured to the base member such that the seat may rotate forward and an energy storing strut including a first end coupled to the base member and a second end coupled to the seat. The seat includes a sealing edge along the bottom thereof, wherein the sealing edge being shaped and dimensioned to seal the space between the base member and the seat when the seat is in a horizontal position;

It is another object of the present invention to provide a toilet seat apparatus including a base member adapted for selective attachment to a toilet and a seat pivotally secured to the base member such that the seat may rotate forward, wherein the seat is of a unitary, one-piece construction. The toilet seat apparatus also includes a release plate facilitating selective attachment of the base member to a toilet. The release plate includes openings spaced and dimensioned for permitting attachment of the release plate to a toilet. The release plate also includes a plurality of tongues shaped and dimensioned for engagement with the base member in a manner coupling the base member to the release plate.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 13 is a cross sectional view of the cable coupling to the detent slide assembly along the line XIII—XIII of FIG. 3.

FIG. 14 is a view of the detent slide assembly along the line XIV—XIV of FIG. 3.

DESCRIPTION OF THE PREFERRED EMBODIMENT

Figure 1:
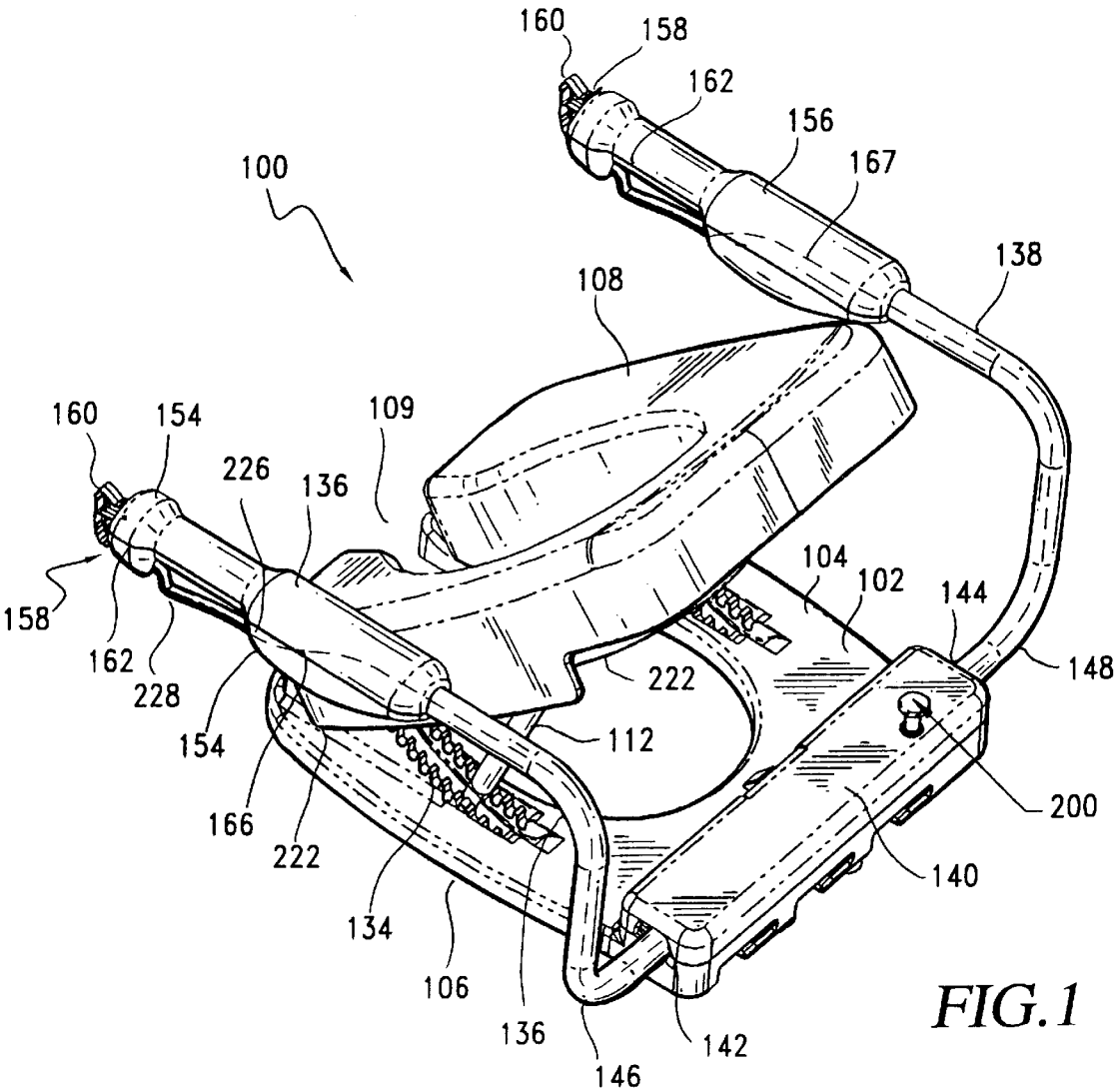
FIG. 1 is a perspective view of a toilet seat made in accordance with the present invention.

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

For the elderly, infirmed, or otherwise disabled persons, simple everyday tasks are become difficult or impossible. To merely lower and raise oneself to and from a toilet, which as a matter of nature is likely to occur several times throughout the course of a day, one might be faced with an uncomfortable challenge. The motions required may cause not only pain and discomfort, but are also accompanied by the possibility of a fall which may cause injury.

Not only is it possible that persons using the toilet may become injured as a result of falling or standing, but others who attempt to provide help may also be subject to undesirable risk. Indeed, persons assisting others in nursing homes and hospitals, among other places, account for a significant number of injuries as their backs tend to be overstrained when lifting a person from a toilet. Finally, as personal privacy is generally preferred when tending to washroom matters, persons will be greatly relieved to have available to them a device which is easy to operate without the aid of others.

Accordingly, a toilet seat which allows one to gently sit on, and rise from, a toilet is herein disclosed. With reference to FIGS. 1–6 and 8–13, a toilet seat 100 in accordance with the present invention is disclosed. The toilet seat 100 is coupled to a standard toilet (not shown) using conventional coupling bolts. Briefly, the present invention uses a stored energy system to lift and lower an individual wishing to use the toilet. Energy from the user's weight being lowered is converted to potential energy in a mechanical strut. When a user wishes to lift oneself from the toilet, the stored energy is expended in a lifting motion which positions the user in a natural standing position. The present invention is highly adjustable for users of various sizes. The present invention is also self contained and does not require an external energy source.

The toilet seat 100 includes a rigid base member 102 adapted to be releasably secured to the toilet via standard mounting hardware or optional quick release hardware (discussed below in greater detail). The base member 102 includes a top surface 104 and a bottom surface 106. The rigid base member 102 is secured to the toilet such that bottom surface 106 faces the toilet and the top surface 104 faces upwardly.

Stand-off members 107*a,* 107*b* having a top portion and a bottom portion extending from the top surface 104 of the base member 102 upward to a pair of supports 216, 218. A seat 108 is pivotally mounted to the supports 216, 218 such that the seat 108 may swing about an arc from a horizontal position to an inclined position.

As discussed below in greater detail, energy storing support struts 112, 114 are coupled between the seat 108 and the base member 102. The energy storing support struts 112, 114 are preferably dual dampened struts including dual orifices for restricting the flow of gas or fluid during both compression and expansion of the strut. However, other struts may be used without departing from the spirit of the present invention. The size of the orifices may be adjusted to control the rate at which the seat rises or lowers. The first end of each strut 112, 114 is pivotally coupled to the underside 220 of the seat 108 and the second end of each strut 112, 114 is pivotally coupled to the top surface 104 of the base member 102. The energy storing support struts 112, 114 are preferably compressed gas devices, although other energy storing support struts may be employed without departing from the spirit of the present invention.

In operation, the struts 112, 114 have a minimally loaded, or relaxed, state and a loaded state. The struts 112, 114 offer resistance to compression when a user sits on the seat 108 and tend to return to their relaxed state when the user lifts from the seat 108. In this way, pressure applied to the seat 108 which tends to force it towards its horizontal position causes the struts 112, 114 to become loaded. Energy is stored in the struts 112, 114 and the struts 112, 114 use the energy to encourage the seat 108 to return to its inclined position.

Figure 7:
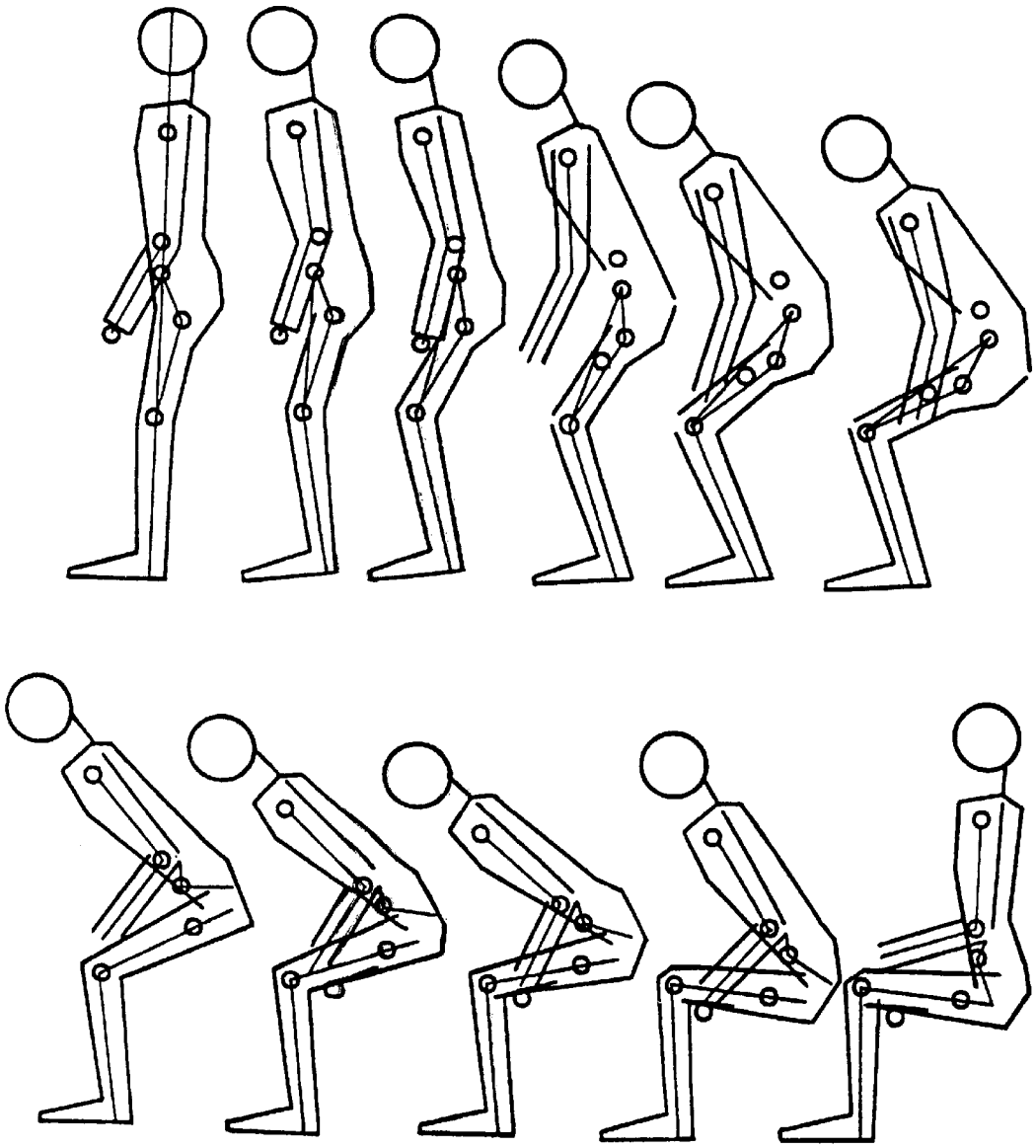
FIG. 7 is a series of diagrams showing a person in transition from a standing position to a sitting position.
Figure 8:
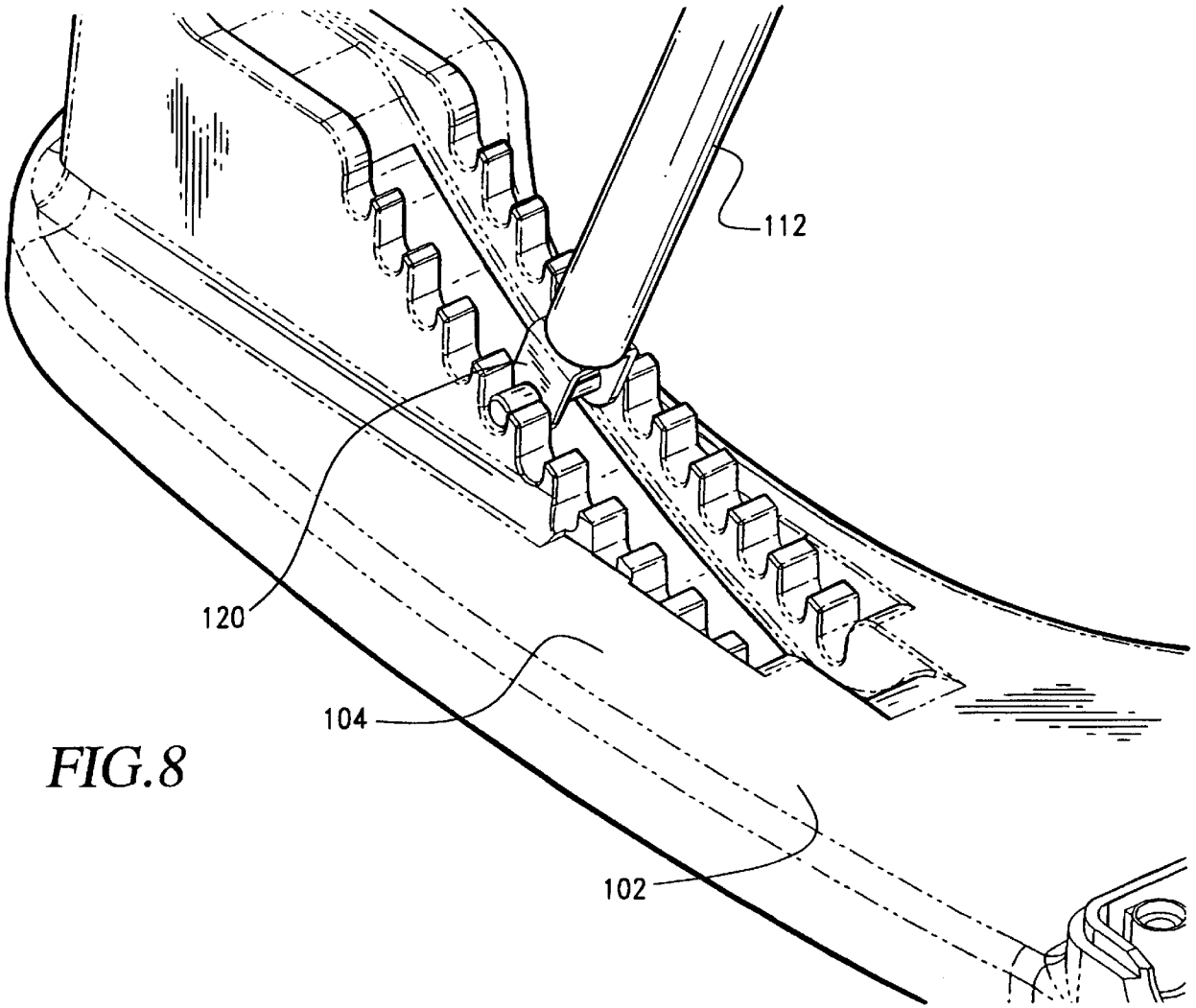
FIG. 8 is a detailed perspective view of the strut adjustment assembly.
Figure 9:
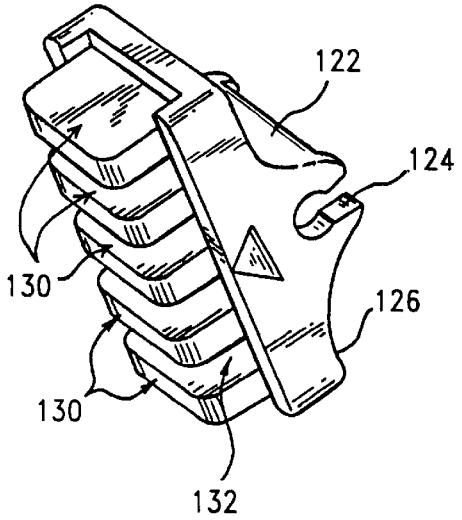
FIGS. 9 and 10 are perspective views of the adjustment block employed in accordance with the embodiment disclosed in FIG. 1.
Figure 10:
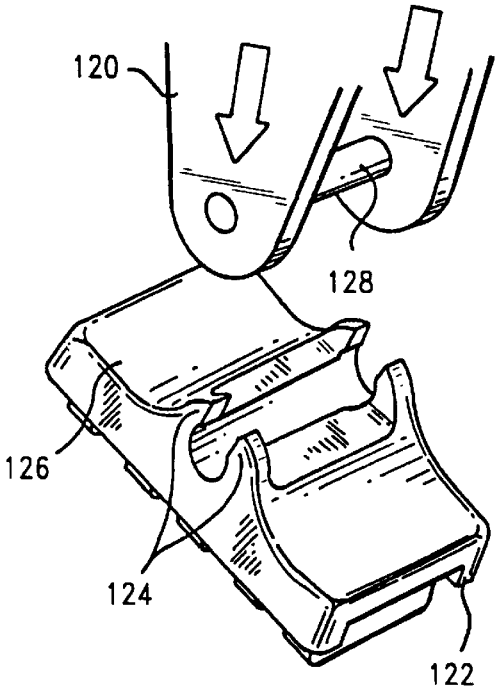
Figure 11:
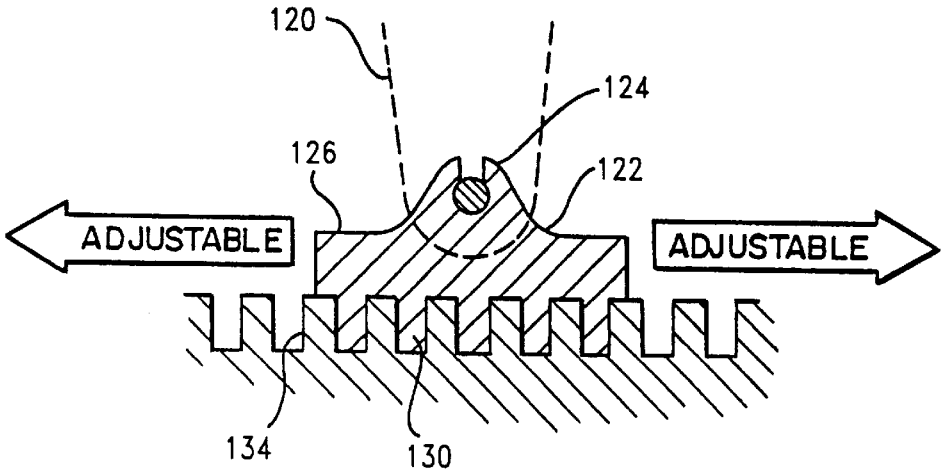
FIG. 11 is a cross sectional view of the adjustment block coupled to the base member.
Figure 12:
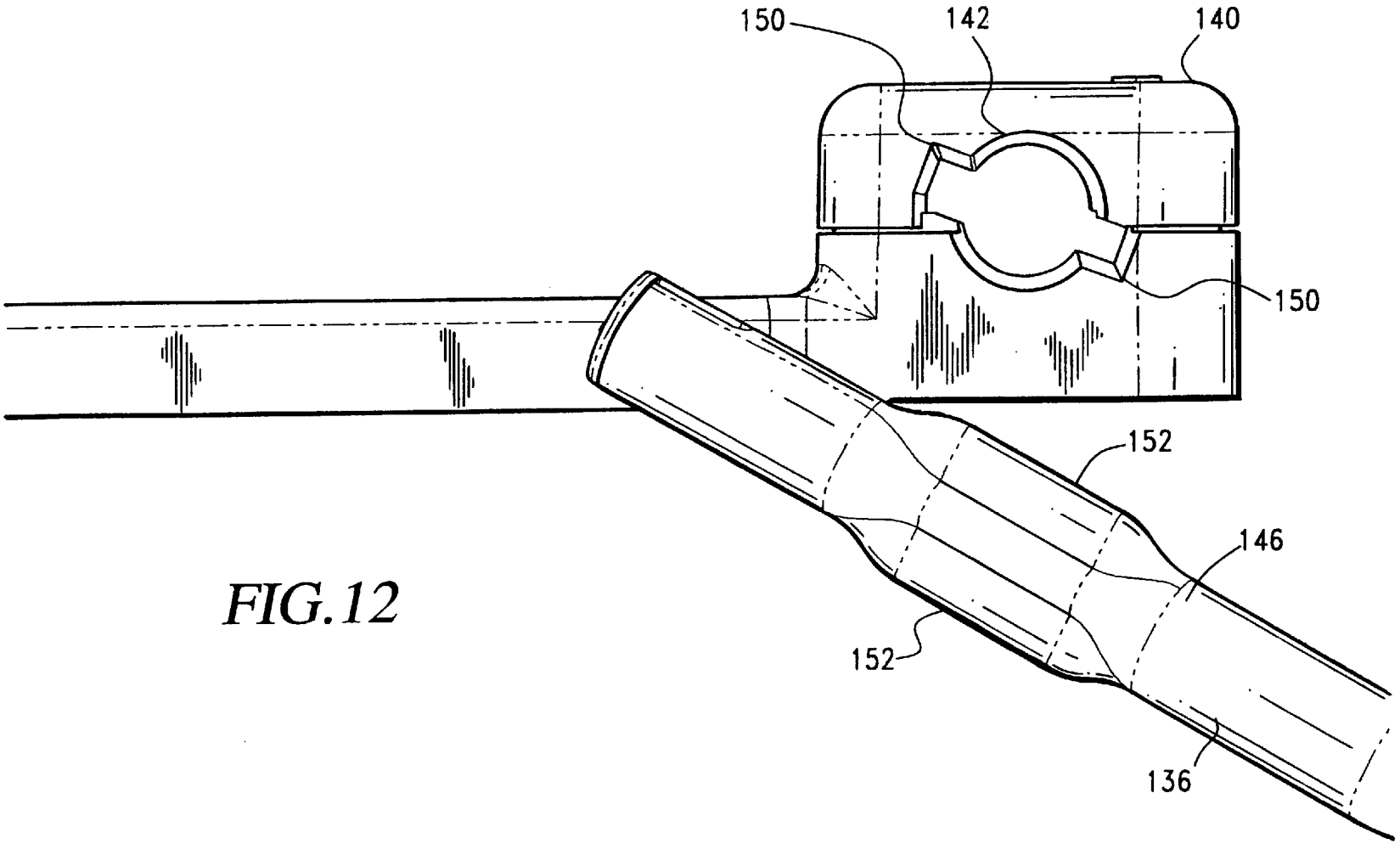
FIG. 12 is a detailed view of the receiving hole and the first end of the first armrest.

FIG. 7 shows the body positions of a person in transition from a standing to a sitting position. In the standing position, the forearms and femur are nearly parallel. As one progresses through the transition to the sitting position, the knees form approximately a 90 degree angle. For most persons, the height of a common toilet seat is lower than the position which would allow the knees to form a 90 degree angle. This is undesirable because it is particularly difficult from that position to apply the leg muscles to again stand up. It may be preferred that one should start from a position like that of the last of the series of FIG. 7 when setting forth to stand. For this reason, a toilet seat of the invention may additionally include a stand-off member of between three and six inches.

Figure 5:
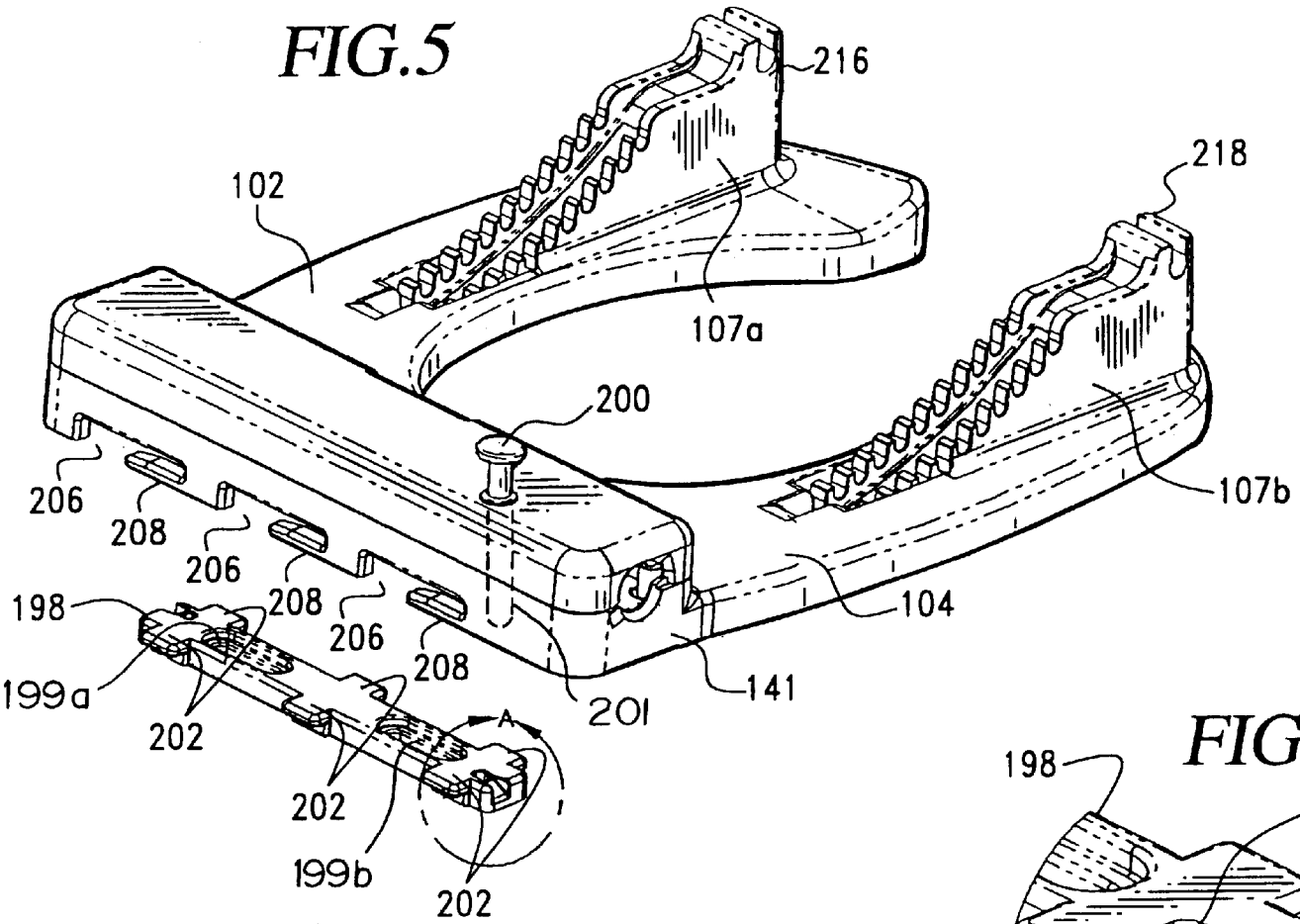
FIG. 5 is a top perspective view of the base member with the release plate exposed.
Figure 5A:
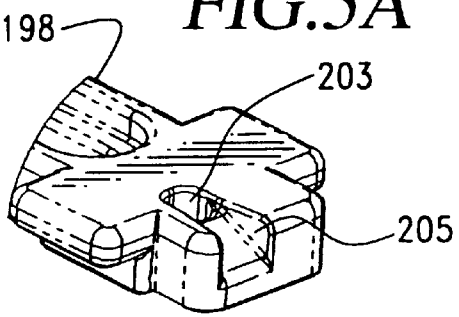
FIG. 5A is a detailed view of the ramp and hole employed in the release plate.
Figure 6:
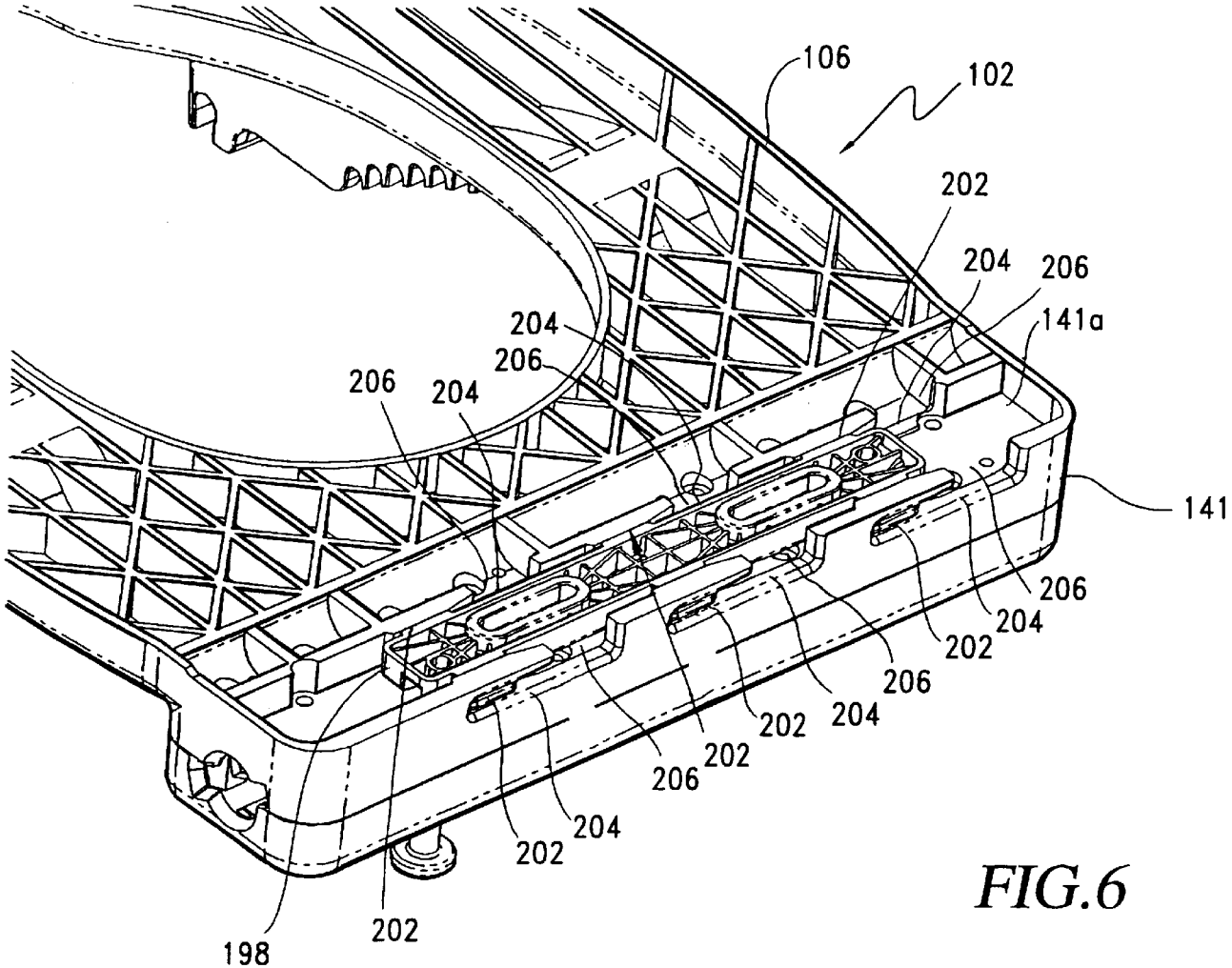
FIG. 6 is a bottom perspective view of the base member with the release plate in position within the base member.

With reference to FIGS. 5 and 6, the base member 102 is selectively provided with a quick release plate 198. The quick release plate 198 is fixedly secured to the toilet and the base member 102 is releasably secured thereto. When an individual wishes to remove the present toilet seat 100, the toilet seat 100 is simply removed by lifting the release plunger 200, moving the base member 102 laterally and lifting upwardly to remove the base member 102 from the quick release plate 198.

More specifically, the release plate 198 is provided with first and second openings 199*a,* 199*b* spaced for receipt of common bolts used in securing a toilet seat to the toilet. The release plate 198 is also provided with a plurality of spaced tongues 202 shaped and dimensioned for selective receipt within L-shaped grooves 204 formed in the rear end 141 of the base member 102. The underside 141*a* of the rear end 141 of the base member 102 includes a cavity shaped and dimensioned to receive the release plate 198 therein. In this way, the base member 102 is placed over the release plate 198 such that the tongues 202 respectively pass through the open ends 206 of the L-shaped grooves 204. The base member 102 is then slid lateral such that the tongues 202 move within the L-shape grooves 204 to a position where upward movement is prevented by the projection 208 defining each of the L-shaped grooves 204.

As mentioned above, the base member 102 is provided with a release plunger 200. The release plunger 200 is downwardly spring biased . The release plunger 200 has a round end 201 which drops into a hole 203 in the release plate 198 when the base member 102 is slid laterally to its final use position. When the release plunger 200 is thus engaged in the hole 203 of the release plate 198, no lateral movement of the assembly is possible. Seating of the release plunger 200 within the hole 203 is facilitated by providing a ramp 205 adjacent the hole 203, which guides the end 201 of the release plunger 200 upwardly and into the hole 203.

When an individual wishes to remove the toilet seat 100, the release plunger 200 is lifted, disengaging the rounded end 201 from the hole 203 in the release plate 198 and permitting lateral movement of the base member 102 relative the release plate 198. With the release plunger 200 raised, one may simply shift the base member 102 laterally, moving the tongues 202 into alignment with the open ends 206 of the L-shaped grooves 204. The base member 102 may then be lifted and removed.

In the event an individual wishes to replace the present toilet seat 100 with a conventional seat, a mirror image release plate, engageable with the release plate 198, may be provided for attachment to the conventional toilet seat brackets. The mirror image release plate would be secured to the toilet seat brackets via suitable fasteners and then the conventional toilet seat may be secured to and removed from the quick release plate 198 in the same manner as the base plate 102.

The seat 108 is pivotally coupled to the top surface 104 of the base member 102. The seat 108 is pivotally mounted such that the seat 108 may swing about an arc from a horizontal position to an inclined position. With this in mind, the seat 108 is provided with first and second laterally spaced pivot pins 212, 214 along opposite sides of the forward end of the seat 108. The pivot pins 212, 214 are preferably screwed 215 in place, although other attaching mechanisms may be used without departing from the spirit of the present invention. The first and second pivot pins 212, 214 are shaped and dimensioned for selective attachment within supports 216, 218 formed in the top surface 104 of the base member 102. The supports 216, 218 are formed to facilitate snap fitting of the pivot pins 212, 214 therein, permitting ready and convenient pivotal attachment of the seat 108 to the underlying base member 102.

By providing laterally spaced pivot pins 212, 214, the hinges of the present toilet seat 100 are spaced in a structurally stable manner. This creates a stable four point support when combined with the struts 112,114 (discussed below in greater detail). The spaced pivot pins 212, 214 further spread forces about the present toilet seat to provide a high safety factor to the overall design. The distinct pivot pins 212, 214 also permit alternate materials to be used in the construction thereof, potentially adding additional strength and durability to the present design.

The hinge design simplifies assembly of the present toilet seat 100. Specifically, the seat 108 is easily installed by dropping the seat 108 onto the base member 102 such that the pivot pins 212, 214 mate with the supports 216, 218 on the top surface 104 of the base member 102. In addition, and since the seat 108 is of a one piece construction and includes no bottom, the user may clearly view the pivot pins 212, 214 and supports 216, 218 while the seat 108 is being secured to the base member 102. The spaced relationship of the pivot pins 212, 214 further enhances assembly by allowing the user to look directly down upon the pivot pins 212, 214 and supports 216, 218 as the seat 108 is being positioned on the base member 102.

Figure 4:
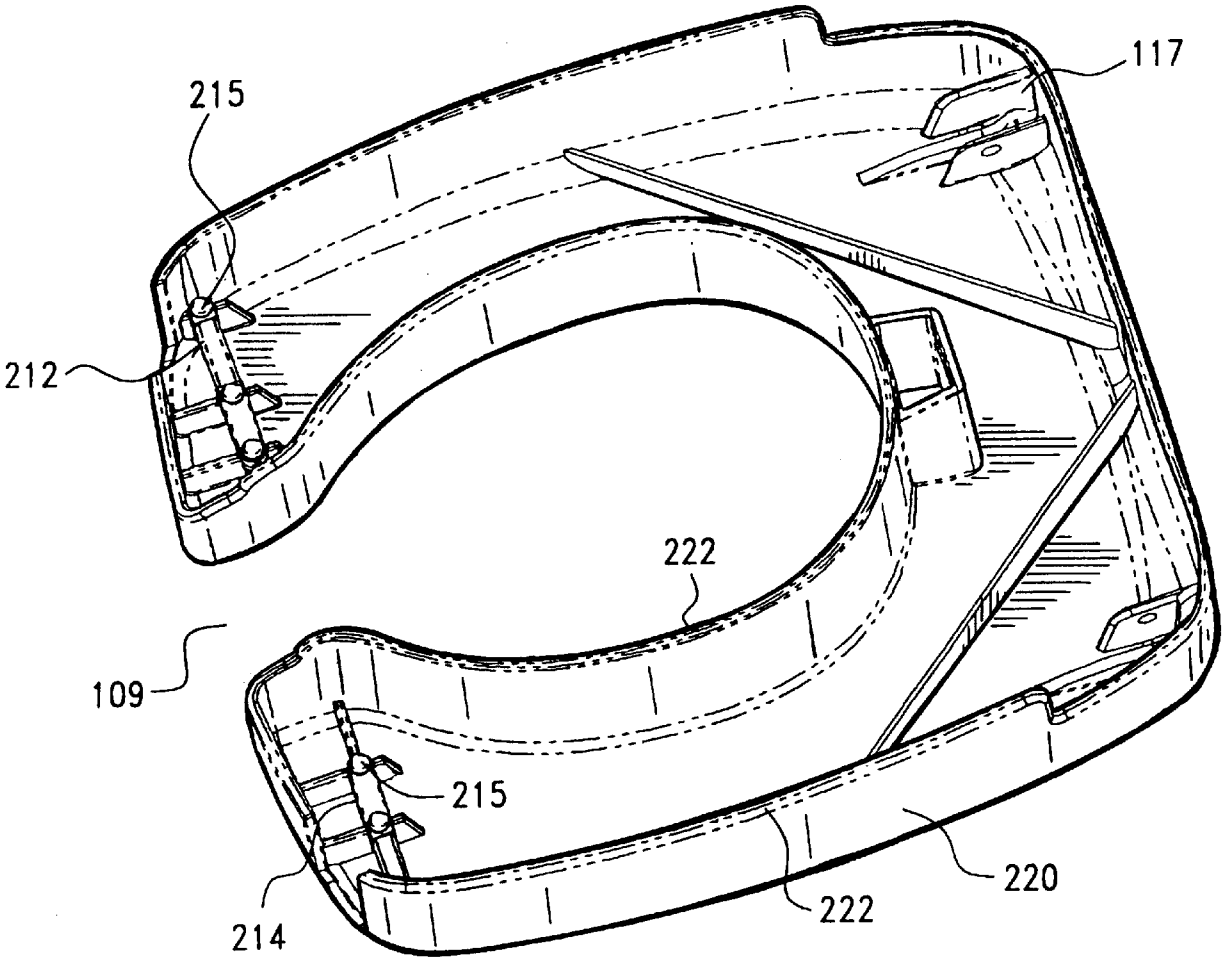
FIG. 4 is a perspective view of the underside of the seat.

As mentioned above, the seat 108 is formed with a one-piece construction. The one-piece construction exhibits no seams and requires no assembly. With reference to FIG. 4, the underside 220 of the seat 108 is open. This open construction reduces the weight of the seat 108 making it easier for weaker users to remove, clean and reposition the seat 108. The open construction of the seat 108 also diminishes closed spaces in which moisture could gather and germs might develop.

The interior and exterior underside edges 222 (see FIGS. 1, 2 and 4) of the seat 108 are shaped and dimensioned to seal against the top surface 104 of the base member 102 when the seat 108 is in its horizontal position. This prevents material from splashing up onto the upper surface 104 of the base member 102 and into the strut assembly area (discussed below in greater detail).

In addition, the seat 108 is C-shaped and is provided with an open front end 109. The use of an open front end 109 enhances access to patients as they use the toilet. This permits assistants to clean the patients who are unable to clean themselves while the user is safely seated and further permits patients to clean themselves from the front end of the seat 108 without the need to move. A C-shaped seat is possible due to the stable four point support structure provided by the present invention.

The toilet seat 100 also includes first and second energy storing support struts 112, 114. The support struts 112, 114 are positioned between the seat 108 and the base member 102, on opposite sides of the toilet seat 100. When pressure is applied to the seat 108 which tends to force the seat 108 toward its horizontal position the struts 112, 114 become loaded. The energy is stored in the struts 112, 114 such that the struts may later use the energy to move the seat 108 upwardly (see FIGS. 1, 2, and 3).

Figure 2:
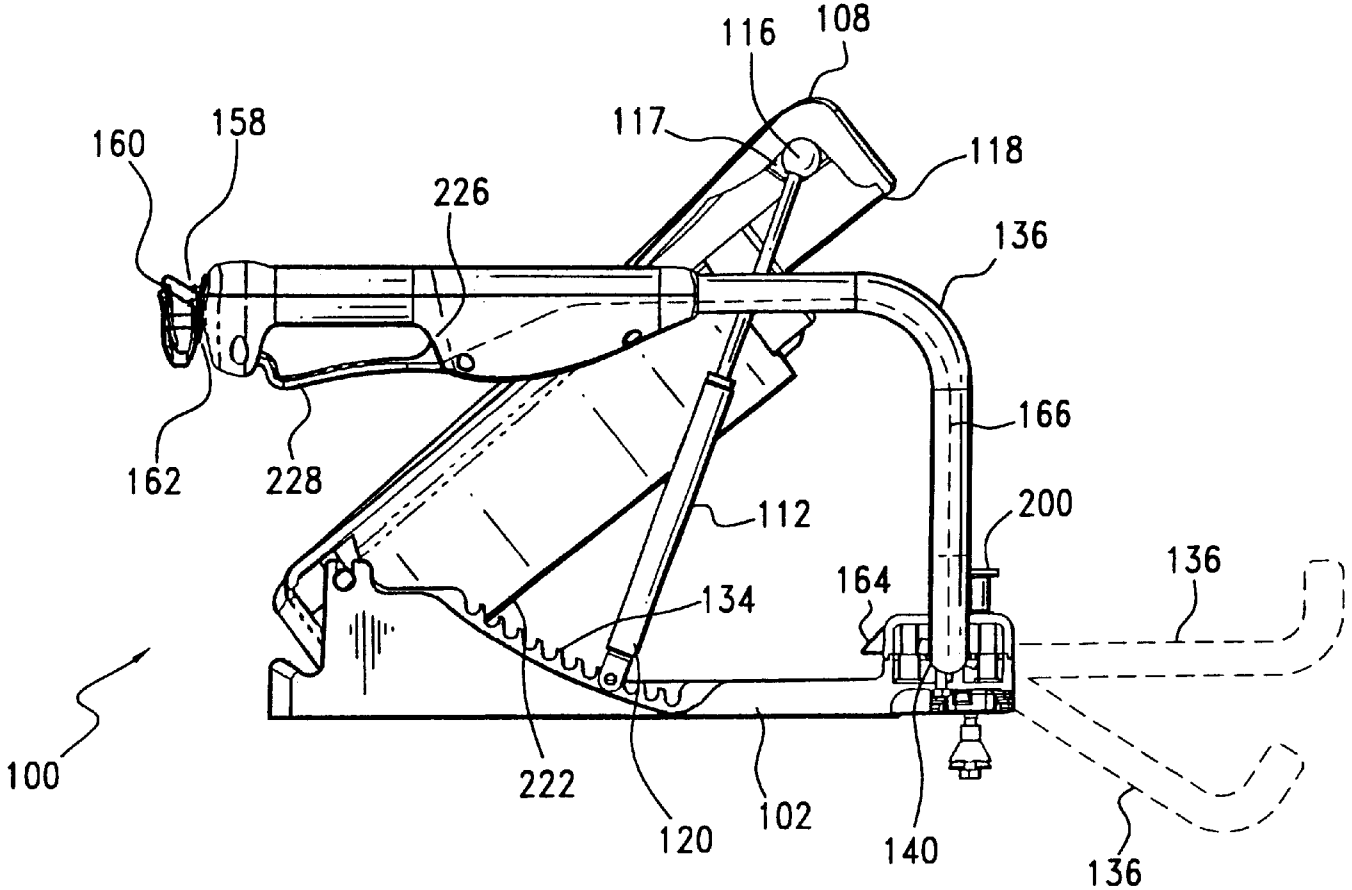
FIG. 2 is a side view of the embodiment disclosed in FIG. 1 with a partial section exposing the strut assembly.
Figure 3:
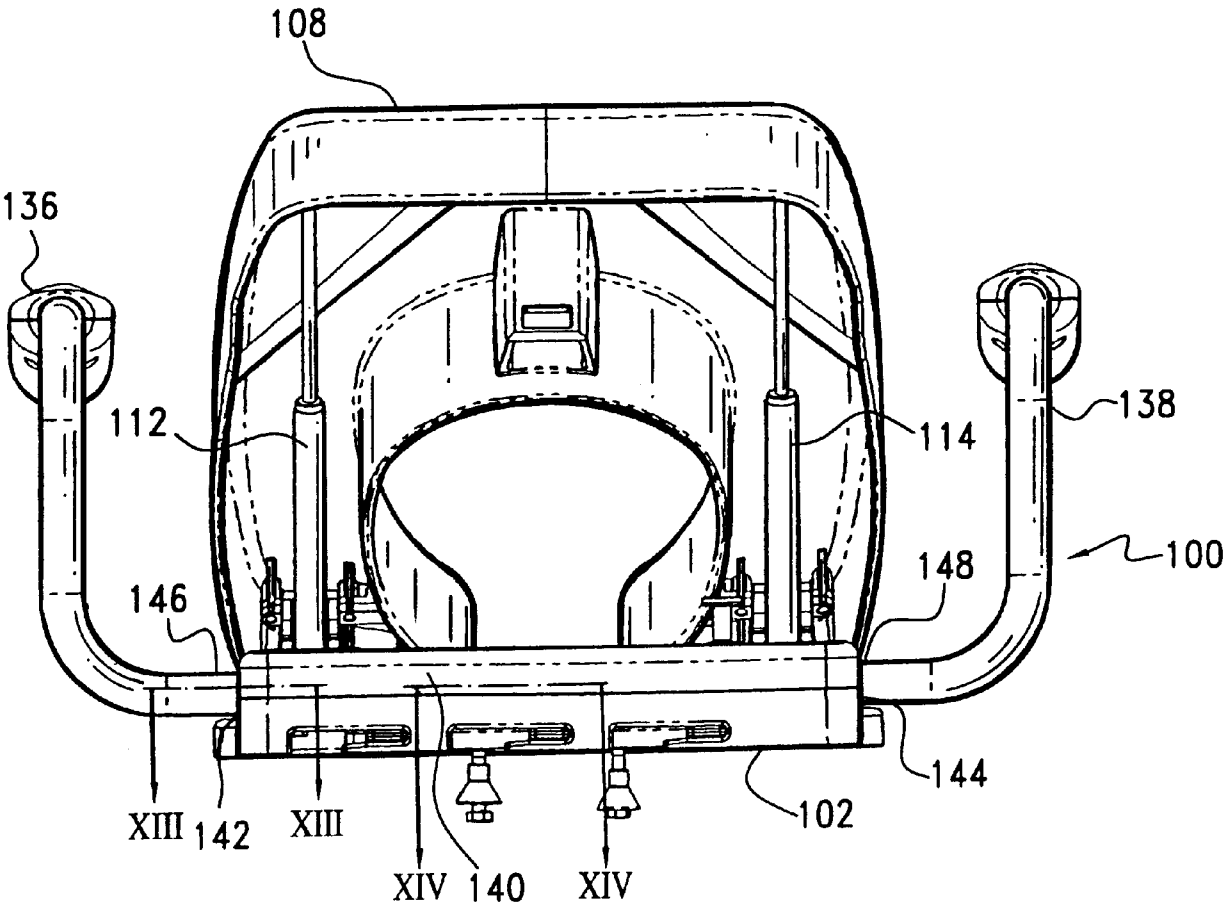
FIG. 3 is a rear view of the embodiment disclosed in FIG. 1.

The support assembly for the struts will now be described with reference to the first strut 112. It should, however, be understood that the strut support assemblies are substantially identical. As shown in FIGS. 1 and 2, the first end 116 of the first strut 112 is pivotally secured to the underside 118 of the seat 108. The first end 116 is ball shaped and snap fits within a like sized recess 117 formed in the formed in the underside 220 of the seat 108. The second end 120 of the first strut 112 is selectively and pivotally secured to the base member 102. In this way, the force applied by the first strut 112 is selectively adjusted by releasably securing the second end 120 of the first strut 112 at different positions along the base member.

The second end 120 of the first strut 112 is selectively clipped at various locations along the base member 102 to adjust the lifting force between approximately 80 and 400 lbs, although this range may be expanded without departing from the spirit of the present invention. The clipping mechanism is disclosed in detail in FIGS. 8, 9, 10 and 11. The second end 120 of the first strut 112 is releasably clipped to an adjusting block 122. The adjusting block 122 includes a clip opening 124 on its upper surface 126 which is shaped and dimensioned to receive the pivot bar 128 on the second end 120 of the first strut 112. The adjusting block 122 is further provided with a plurality of teeth 130 along its bottom surface 132. The teeth 130 are shaped and dimensioned to engage a series of recesses 134 formed along the base member 102. By moving the adjusting block 122 along the series of recesses 134 formed in the base member 102 a user may adjust the force applied by the first strut 112.

The present toilet seat 100 is provided with first and second armrests 136, 138 positioned on opposite sides of the toilet seat 100. The first and second armrests 136, 138 are rotatably and releasably coupled to a support hub 140 positioned along the rear end 141 of the base member 102. Specifically, the support hub 140 is provided with first and second receiving holes 142, 144 shaped and dimensioned for respectively receiving the first ends 146, 148 of the first and second armrests 136, 138.

The releasable feature of the armrests 136, 138 employed with the present toilet seat 100 will now be described with reference to the first armrest 136 as shown in FIGS. 1, 2, 3 and 12. It should, however, be understood that second armrest 138 is secured to the support hub 140 in the same manner as described below with reference to the first armrest 136. With reference to the first end 146 of the first armrest 136 and the first receiving hole 142 of the support hub 140, the receiving hole 142 is shaped to receive and release the first armrest 136 only when the armrest 136 is rotated approximately 110 degrees from its starting position as shown in FIG. 2.

The receiving hole 142 is accordingly provided with notches 150 oriented to align with flattened portions 152 on the first end 146 of the first armrest 136 only when the armrest 136 is rotated approximately 110 degrees from its starting position. When the notches 150 and the flattened portions 152 are aligned, the first end 146 of the first armrest 136 may be freely inserted into the receiving hole 142 or removed from the receiving hole 142. When the armrest 136 is positioned at other angular orientations, the armrest 136 is securely held in position such that the armrest 136 may freely rotate relative to the support hub 140. In this way, the armrest 136 may be easily removed from the present toilet seat 100 to accommodate the needs of certain individuals and allow for easy storage of the present toilet seat 100. The flattened portion 150 also serves as an anti-rotation feature to support arms in the down position.

By permitting removal of the armrest 136 when the armrest 136 is rotated to approximately 110 degrees, the armrest 136 is free to rotate from 0 degree to over 90 degrees without fear that the armrest 136 will become disengaged. In fact, the conventional positioning of the present toilet seat will prevent the armrest 136 from rotating more than approximately 90 degrees, because the armrest 136 will contact a wall before moving to a position where the armrest may be removed from the support hub 140. With this in mind, the release orientation of the armrest 136 and receiving hole 142 may be varied to accommodate different uses of the present toilet seat 100 without departing from the spirit of the present invention.

The second ends 154, 156 of the first and second armrests 136, 138 are provided with handles that user's may grip as they move onto, and off of, the present toilet seat 100. The second ends 154, 156 of the first and second armrests 136,138 are also provided with retractable clothing holders 158. Briefly, many elderly individuals find it very difficult to pull their clothing up after they have removed their clothing to use the toilet. If the user allows his or her clothing to fall to the floor while using the toilet, he or she must bend to the floor to pick up the dropped clothing. Many elderly people find this very difficult and attempt to hold onto their clothing while they use the toilet. This is also very difficult, and makes the process of using the toilet even more difficult for elderly users.

With this in mind, the present toilet seat 100 is provided with retractable clothing holders 158 secured to the second ends 154, 156 of the first and second armrests 136, 138.

Each holder 158 includes a clip 160 secured to the free end of a cord 162. The cord 162 is stored in the second ends 154, 156 of the first and second armrests 136, 138, and may be retracted when a user wishes to secure the clip 160 to his or her clothing. The cord 162 is spring biased to return to its retracted positioned within the second ends 154, 156 of the armrests 136, 138.

In use, an individual wishing to use the toilet simply secures the holders 158 to his or her clothing by securing the clips 160 to the clothing prior to using the toilet. The clips 160 are preferably 3 lb. tear away clips such that they will simply unclip if a user should walk away from the toilet without remembering to unclip his or her clothing. Once the holders 158 are properly secured to the user's clothing, the user may employ the toilet in the manner discussed above. When the user is finished and is in a standing position, he or she may pull on the cords 162 to pull the clothing up to a convenient position for dressing.

The present toilet seat 100 is also provided with a convenient release mechanism for holding the seat in its horizontal position, with the strut loaded. Specifically, and with reference to FIGS. 1, 2, 13 and 14, the support hub 140 is provided with a retractable detent 164 that selectively engages the seat 108 to hold it in its horizontal, loaded position. The detent 164 is spring biased to a projected position and is retracted by actuating hand cables 166, 167 provided adjacent the second ends 154, 156 of the first and second armrests 136, 138.

The hand cables 166, 167 of the first and second armrests 136, 138 are mirror images and will be described herein with reference to the first armrest 136. The hand cable 166 includes a first end 224 and a second end 226. The second end 226 of the hand cable 166 is connected to a hand lever 228, similar to a bicycle brake lever, at the second end 154 of the armrest 136. The hand lever 228 is pivotally mounted to the second end 154 of the first armrest 136. The hand lever 228 actuates the cable 166 in a manner offering a consistent 2:1 leverage throughout its travel.

The hand cable 166 is coupled to the detent 164 via the coupling assembly disclosed in FIGS. 2, 13 and 14. The coupling assembly will also be described below with reference to the first armrest 136, although it should be understood that the coupling assembly is substantially identical for the second armrest 138. Specifically, the hand cable 166 extends into the body of the first armrest 136 to the first end 146 of the first armrest 136. The first end 224 of the cable 166 is connected to a spring loaded connecting member 168 located adjacent the first end 146 of the first armrest 136.

The connecting member 168 is mounted at the first end 146 of the first armrest 136 such that the cable 166 pulls the connecting member 168 into the body of the armrest 136 when a user compresses the exposed hand lever 228, which pulls the cable 166 as the spring 170 forces the connecting member 168 toward the first end 146 of the armrest 136 when the hand lever 228 and hand cable 166 are released. For reasons that will become apparent from the following disclosure, the connecting member 168 is prevented from rotating within the first end 146 of the first armrest 136 by slidably securing the connecting member 168 within grooves 172 formed in the first end 146 of the first armrest 136. The grooves 172 permit the connecting member 168 to longitudinally slide within the second end 146 of the first armrest 136, but prevent the connecting member 168 from rotating therein.

When the hand lever 228 and cable 166 are released and the connecting member 168 is moved to the outer edge 174 of the second end 146 of the first armrest 136, a hooked projection 176 of the connecting member 168 extends slightly beyond the edge 174 of the first end 146 of the first armrest 136 for attachment to the detent slide assembly. Specifically, and with reference to FIG. 13, the hooked projection 176 is selectively coupled to the first end 178 of the first latch arm 180 of the detent slide assembly. Once coupled to the first end 178 of the first latch arm 180, movement of the connecting member 168 caused by gripping the hand lever 228 pulls the first latch arm 180 toward the first end 146 of the first armrest 136 to force the detent 164 to a retracted position.

The detent slide assembly is disclosed in FIG. 14, and includes a detent 164 mounted in a track 182 for controlled movement. The detent 164 includes an upwardly extending camming pin 184 which engages the camming surfaces 186, 188 formed at the second ends 190, 192 of the first and second latch arms 180, 194. In use, as either the first or second latch arm is drawn away from the detent 164 by compressing the hand lever 228 to pull the hand lever 166, the camming surfaces 186, 188 formed on the second ends 190, 192 of the first and second latch arms 180, 194 act upon the camming pin 184 to force the detent 164 to a retracted position. Once the force applied by the hand lever 228 and hand lever 166 is released, the spring 196 biases the detent 164 back to its projected position. In this way, the detent 164 is used to capture or release the seat 108 as is desired by the user of the present toilet.

In accordance with the prior disclosure that the armrests are releasably and pivotally coupled to the support hub 140, the first connecting member 168, and particularly, the hooked projection 176, is releasably coupled to the first end 178 of the first latch arm 180. Specifically, the hooked projection 176 is shaped and dimensioned such that it disengages from the first end 178 of the first latch arm 180 when the first armrest 136 is rotated for release from the support hub 140. Similarly, the hooked projection 176 engages the first end 178 of the first latch arm 180 when the first arm rest 136 is rotated to its use position in which the handles are substantially parallel to the base member 102. This engagement structure is achieved by shaping the hooked projection 176 and the first end 178 of the first latch arm 180 such that they do not engaged at a first angular orientation, but do engage at a second angular orientation. In this way, the armrests are easily removable, without disrupting the release mechanism provided by the detent and its associated structure.

Although the present invention has been described in considerable detail with clear and concise language and with reference to certain preferred versions thereof including the best mode anticipated by the inventor, other versions are possible. Therefore, the spirit and scope of the appended claims should not be limited by the description of the preferred versions contained therein.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A toilet seat apparatus comprising:

a base member adapted for selective attachment to a toilet;

a seat pivotally secured to the base member such that the seat may rotate forward, the seat being of a unitary, one-piece construction;

a pair of energy storing struts including a first end coupled to the base member and a second end coupled to the seat;

a holding means for preventing the energy storing struts from applying upward force on the seat until the holding means is actuated by a release, the holding means includes a retractable detent coupled to the base member for selectively engaging the seat and holding the seat in its horizontal position with the struts loaded wherein the retractable detent is actuated by a cable coupled to the base member for easy access by a user; and at least one armrest coupled to the base member, wherein the at least one armrest includes a hand lever coupled to the retractable detent for actuating the retractable detent.

2. The toilet seat according to claim 1, wherein the seat is C-shaped and includes an open front portion.

3. A toilet seat apparatus comprising:

a base member adapted for selective attachment to a toilet;

a seat pivotally secured to the base member such that the seat may rotate forward, the seat including laterally spaced first and second pivot pins shaped and dimensioned for respective receipt in supports formed in a top surface of the base member, a pair of energy storing struts each including a first end coupled to the base member and a second end coupled to the seat.

4. A toilet seat according to claim 3, wherein the seat includes a front portion and a rear portion; the front portion being pivotally connected to the toilet and the rear portion being movable about an arc, whereby the seat is movable from a substantially horizontal position to an inclined position.

5. A toilet seat according to claim 3, further including a holding means for preventing the energy storing struts from applying upward force on the seat until the holding means is actuated by a release.

6. The toilet seat according to claim 3, wherein the second end of each energy storing strut is shaped and dimensioned to snap fit within a recess formed in an underside of the seat.

7. A toilet seat apparatus comprising:

a base member adapted for selective attachment to a toilet;

a seat pivotally secured to the base member such that the seat may rotate forward, the seat including a sealing edge along the bottom thereof, the sealing edge being shaped and dimensioned to seal the space between the base member and the seat when the seat is in a horizontal position;

a pair of energy storing struts each including a first end coupled to the base member and a second end coupled to the seat.

8. A toilet seat according to claim 7, wherein the seat includes a front portion and a rear portion; the front portion being pivotally connected to the toilet and the rear portion being movable about an arc, whereby the seat is movable from a substantially horizontal position to an inclined position.

9. A toilet seat according to claim 7, further including a holding means for preventing the energy storing struts from applying upward force on the seat until the holding means is actuated by a release.

10. The toilet seat according to claim 7, wherein the seat is C-shaped and includes an open front portion.

11. A toilet seat apparatus comprising:

a base member adapted for selective attachment to a toilet;

a seat pivotally secured to the base member such that the seat may rotate forward, the seat being of a urutary, one-piece construction; and a release plate facilitating selective attachment of the base member to a toilet, the release plate including openings spaced and dimensioned for permitting attachment of the release plate to a toilet, the release plate also including a plurality of tongues shaped and dimensioned for engagement with the base member in a manner coupling the base member to the release plate; and wherein the base includes a plurality of L-shaped grooves shaped and dimensioned for respectively receiving the plurality of tongues.

12. The toilet seat apparatus according to claim 11, further including a pair of energy storing struts each including a first end coupled to the base member and a second end coupled to the seat.

13. The toilet seat apparatus according to claim 11, wherein the tongues are outwardly extending members.

14. The toilet seat apparatus according to claim 11, wherein the release plate includes a latch shaped and dimensioned for engaging the base member to prevent lateral movement of the base member relative to the release plate.

15. The toilet seat apparatus according to claim 14, wherein the latch includes a notch which engages the base member to prevent lateral movement of the base member relative to the release plate.

* * * * *